US006658827B2

(12) United States Patent
Brownlie

(10) Patent No.: US 6,658,827 B2
(45) Date of Patent: Dec. 9, 2003

(54) INTERFACE PADS

(76) Inventor: Alan W. Brownlie, 532 E. Log Hill Rd., Pagosa Springs, CO (US) 81147-1690

( * ) Notice: Subject to any disclaimer, the term of this patent is extended or adjusted under 35 U.S.C. 154(b) by 0 days.

(21) Appl. No.: 10/219,715

(22) Filed: Aug. 15, 2002

(65) Prior Publication Data

US 2003/0177742 A1 Sep. 25, 2003

Related U.S. Application Data

(60) Provisional application No. 60/312,479, filed on Aug. 15, 2001.

(51) Int. Cl.[7] ..... B68C 1/10; B68B 3/08

(52) U.S. Cl. ..... 54/66; 54/68; 54/44.5

(58) Field of Search ..... 54/65, 66, 68, 54/44.5; 251/208

(56) References Cited

U.S. PATENT DOCUMENTS

| | | | | | |
|---|---|---|---|---|---|
| 3,466,852 | A | * | 9/1969 | Stoner | 54/65 |
| 3,988,790 | A | | 11/1976 | Mracek et al. | 5/86 |
| 4,025,974 | A | | 5/1977 | Lea et al. | 5/367 |
| 4,127,906 | A | | 12/1978 | Zur | 5/66 |
| 4,171,004 | A | | 10/1979 | Cerrato et al. | 137/116 |
| 4,624,277 | A | | 11/1986 | Veite | 137/116.3 |
| 4,696,320 | A | | 9/1987 | Bull | 137/116.5 |
| 4,962,921 | A | | 10/1990 | Simmonms | 272/1 B |
| 4,979,249 | A | | 12/1990 | Meade, II | 5/441 |
| 5,027,589 | A | * | 7/1991 | Gleb et al. | 54/66 |
| 5,079,873 | A | | 1/1992 | Smith | 49/477 |
| 5,119,618 | A | | 6/1992 | Streck | 54/66 |
| 5,191,752 | A | | 3/1993 | Murphy | 54/44.5 |
| 5,249,318 | A | | 10/1993 | Loadsman | 5/453 |
| 5,282,286 | A | | 2/1994 | MacLeish | 5/654 |
| 5,330,249 | A | | 7/1994 | Weber et al. | 297/214 |
| 5,363,631 | A | | 11/1994 | Garrison | 54/66 |
| 5,452,741 | A | | 9/1995 | Tomita et al. | 137/505.26 |
| 5,456,072 | A | | 10/1995 | Stern | 54/44.5 |
| 5,561,873 | A | | 10/1996 | Weedling | 5/711 |
| 5,575,139 | A | | 11/1996 | Green | 54/66 |
| 5,595,209 | A | | 1/1997 | Atkinson et al. | 137/116.5 |
| 5,782,070 | A | | 7/1998 | Knight et al. | 54/66 |
| 5,787,692 | A | | 8/1998 | Purdy | 54/66 |
| 5,802,823 | A | | 9/1998 | Woods | 54/66 |
| 5,834,543 | A | | 11/1998 | Garrison | 524/198 |
| 5,934,280 | A | | 8/1999 | Viard et al. | 128/845 |
| 6,050,067 | A | | 4/2000 | Knight et al. | 54/44.6 |
| 6,065,273 | A | | 5/2000 | Schneider | 54/66 |
| 6,125,616 | A | | 10/2000 | Brown | 54/66 |
| 6,209,578 | B1 | | 4/2001 | Newton | 137/505.41 |
| 6,370,850 | B1 | * | 4/2002 | Zilka | 54/66 |
| 6,415,583 | B1 | * | 7/2002 | Landi et al. | 54/65 |
| 6,421,989 | B1 | * | 7/2002 | Leson | 54/66 |

* cited by examiner

*Primary Examiner*—Charles T. Jordan
*Assistant Examiner*—Elizabeth Shaw
(74) *Attorney, Agent, or Firm*—Eugene Stephens & Associates; Steven R. Scott

(57) ABSTRACT

These interface pads have a right and a left inflatable member with the volume of air in each of these inflatable members being independently adjustable. Each member is adapted to provide an interface between one side of a load-bearing animal and a load-supporting structure such as a saddle. Connecting means span the spinal area of the animal and link the members to one another in a manner that avoids the placement of any substantial compression on the animal's supraspinous ligament. Moreover, a gullet channel is maintained so as to allow appropriate ventilation in this area. The inflatable members are constructed of a foam core wholly surrounded by and bonded to a pair of thin skins or panels, forming a fluid tight envelope. A valve is disposed between the chamber formed by the envelope and the ambient environment. After allowing inflation of an air pad of this type and placing a load (such as the saddle and/or rider) thereon, the valve can be opened. In this situation, the air pad will conform to the contours and configuration of both saddle and animal until it reaches a point where the pressure exerted by foam and air remaining in the foam matches the exterior pressure placed on its various parts. The use of a proportional valve is preferred as this makes the process virtually automatic.

59 Claims, 16 Drawing Sheets

INTERFACE PADS

This application claims the benefit of U.S. Provisional Application No. 60/312,479, filed on Aug. 15, 2001, which provisional application is incorporated by reference herein.

TECHNICAL FIELD

My invention pertains generally to the field of equine saddles and saddle pads. More particularly, it is concerned with interface pads placed between saddle and horse, horse and rider, and/or between saddle and rider.

BACKGROUND

It is a recognized fact that most saddles do not fit most horses. Production saddles are made to fit a size and type of horse and rider in general. However, no horse is completely symmetrical. All have some unevenness of frame and proportion that can lead to an improper fit and interface between horse and saddle. This can, in turn, lead to discomfort and injury to the horse. Even custom saddles made to suit exacting measurements taken from a standing animal may not fit properly after the animal is cinched to secure the saddle, is mounted and adapts to the load, and then moves under the load. Further, the contour of the horse's back changes as it turns and moves about. Thus, even a saddle that fits properly when the horse is at rest may cause problems when the horse is in motion. In addition to this, the rider's weight may be unevenly distributed and may shift during riding. Finally, not all saddles are properly balanced and symmetrical. Some are produced with defects and some can become warped or crooked with use.

Given the foregoing facts, it is almost imperative to provide some type of saddle pad between saddle and horse in order to mediate the differences, and soften contact, between the horse's back and the lower surfaces of the saddle. This need is particularly acute along the horse's spine, which is extremely sensitive. Indeed, all contact with the spine of the animal should be eliminated if possible. Thus, almost all saddles incorporate a raised "gullet channel" along the underside of the saddle over the horse's spine. This serves to limit or eliminate contact with the supraspinous ligament, which runs along the vertical processes of the horse's dorsal spine, permitting it to move and be free from any pressure. It is also a valuable aid in cooling the animal.

Numerous "saddle padding" arrangements have been proposed, patented, and/or marketed in an attempt to satisfy the interface needs described above. Traditional saddle pads and their more usual modifications generally rely on a single thickness of some semi-shock-absorbing material to mediate the differences between horse and saddle. However, these pads serve only to very partially distribute the load and pad the interface between saddle and horse. In addition, a single pad that bridges the back of the animal not only contacts the horse's spinal area, it tends to inhibit cooling air circulation and freedom of movement in turning, collection and other maneuvers. Even those that are provided with openings at the top intersection of their two sides for cooling do not usually allow a free flow of air for the full length of the gullet. These problems are not solved by the substitution of a single thickness of foam or other compressible material for traditional saddle blanket materials. Further, while these new materials help distribute the load, they do nothing to alleviate problems that arise due to differences between the two sides of the animal.

The more innovative approaches taken in some modern arrangements address a few of the problems discussed above, but still fail to arrive at a totally satisfactory solution. Representative examples of such attempts can be seen in the following U.S. Patents:

U.S. Pat. No. 5,119,618 issued to Streck in 1992 for a "Saddle-Fault Correcting Saddle Pad."

U.S. Pat. No. 5,782,070 issued to Knight et al. in 1998 for a "Method and Apparatus for Padding and Cushioning an Equine Saddle."

U.S. Pat. No. 5,787,692 issued to Purdy in 1998 for a "Method and Apparatus for Saddling a Horse."

U.S. Pat. No. 5,119,618 ("Streck") describes, in general terms, a corrective saddle pad having two parts/sides for placement on opposite sides of the horse. Each side features a "force transfer means" in the form of a compartment filled with fluid gel, a compartment enclosing some type of "flat, rigid, substantially non-shock absorbing pressure plate member", or both. Despite its advantages, the Streck arrangement does not deal with the fact that more padding or gel or air may be required on one side of the horse than the other to deal with the inequalities discussed above. Further, the addition of a rigid pressure plate member will hamper the ability of the horse to turn.

U.S. Pat. No. 5,782,070 ("Knight") describes a saddle pad having a "cushion" in the form of a foam-filled air bladder with a valve that is inserted between the layers of the saddle pad. The saddle pad itself has an upper and lower section. Both of these sections have an inner layer resistant to the absorption of moisture; an outer layer having a soft, deep pile for contacting an underside of the saddle and for contacting the equine's back; and a foam inner core sandwiched between the inner and outer layers. A pocket is formed between the upper and lower sections for receiving the cushion. Unfortunately, Knight's design with a centrally located cushion does nothing to deal with inequalities between different sides of the animal. Indeed, it makes matters worse, as air in the cushion is not restrained from rushing to the high side of the horse/saddle combination. This creates additional pressure on the other side of the horse and can even unseat the rider. Further, its centrally located cushion not only impinges directly on the spine of the animal being ridden, it blocks cooling air circulation in and through the gullet. Finally, Knight's centrally located cushion is not in a position to directly pad and mediate contact between the saddletree for the saddle and the sides of the horse. Thus, it is useless for this purpose.

U.S. Pat. No. 5,787,692 ("Purdy") describes a system with side airbags having discrete upper and lower chambers with separate inflation means for each chamber. This system has some utility, but lacks the simplicity and durability necessary in a system intended for use in this application. Purdy prescribes a system of pumps and chambers that may be of some use in adjusting for extreme structural malformations in a horse to be ridden, but is too cumbersome and complex for most riders. In addition, the open air chambers with spot welds and line welds of the type Purdy describes are unlikely to long survive the extreme pressures and jolting shocks associated with horseback riding. In this regard, it should be remembered that the interface system under consideration will be positioned between, and be required to absorb the shocks occasioned by, the jolting movements of an animal weighing approximately 1200 pounds and a saddle/rider combination weighing approximately 200 pounds. Finally, Purdy fails to make any provision for removing pressure from the animal's spine and for allowing air to circulate freely in and through the gullet. Support or attachment of two side pads should bridge this area, not touch the back ligament, and provide an uninterrupted flow of air for the length of the gullet. Purdy, like other inventors of prior art interface pads, fails to take these factors into consideration.

SUMMARY OF THE INVENTION

In view of the foregoing considerations and the failure of prior art devices to adequately address these considerations, it is clear that the ideal animal/saddle and rider interface should be durable and include many or all of the following features: (1) means for automatically alleviating and mediating mismatches between a saddle or saddle tree and a load-bearing animal so that the entire load is distributed evenly over the length of the tree on both sides; (2) means for automatically compensating for differences between the two sides of the animal so as to equal and level the animal's load; (3) means for automatically distributing and/or otherwise compensating for uneven static or dynamic side-to-side and front-to-back loads such as those caused by unequal conformation or loading or movement of the rider; (4) means for automatically absorbing and distributing shock and vibration while traveling; (5) means for automatically adjusting each of the foregoing when necessary due to environmental changes (e.g.—air pressure changes) or load changes; (6) means for reducing or eliminating slippage of the interface on the horse or saddle on the interface; (7) means for avoiding contact with the spinal area of the horse; (8) means for encouraging and allowing the free circulation of air in and through the gullet of the saddle; (9) means for expediting the evaporation of perspiration and moisture from the horse and interface including means for making the pad as thin as possible; and (10) means for automatically adapting to the movement of the animal in flexing and turning.

The present invention is intended to meet the aforementioned criteria and more. An interface pad according to one preferred embodiment of the invention is comprised of at least a first and a second discrete inflatable member directly or indirectly linked to one another. The volume of air in each of these inflatable members is capable of independent adjustment. For convenience, the first member is referred to as the left member and the second member is referred to as the right member. The right member is adapted to provide an interface between the right side of a load-bearing animal and the right portion of a load-supporting structure such as a saddle. The left member is adapted to provide an interface between the left side of the load-bearing animal and the left portion of the load-supporting structure. Connecting means are provided to span the spinal area of the animal so as to mechanically link the first and second members to one another.

In one embodiment, the connecting means is a separate component subsequently integrated into or onto the inflatable members such as by attaching one or more straps or clips to each inflatable member. In another embodiment, the connecting means is an integral component, such as the flexible panels used to create the inflatable members, which spans from one member to the other member. In still another embodiment, the connecting means is an auxiliary non-integrated component wherein the connection between inflatable members is by way of a receiving structure adapted to individually receive each inflatable member.

The invention is also directed to retrofit applications wherein two inflatable members are adapted to link with a user's existing pad arrangement. In this embodiment, each member is removably attachable to the existing pad at approximately the location of the animal's flank where a saddle would ride. The removability aspect can be accomplished by any viable two-part attachment means such as a hook and loop arrangement (VELCRO®), snaps, grommets, and line, etc. wherein one part is integrated into the user's pad and the other part is integrated into the inflatable member.

In other possible embodiments, my invention can be used as (1) a bareback pad (with the addition of means—such as a strap—to hold it in position on the horse) or (2) a rider pad (with the addition of means to hold it in position on a saddle). However, in all embodiments, neither inflatable member either directly or via the connection means substantially compresses the spine of the load-bearing animal when positioned thereon. In this manner, any loads placed on the animal will not substantially contact the animal's supraspinous ligament. Moreover, a gullet channel is maintained so that appropriate ventilation and animal comfort occur.

To overcome many of the drawbacks of the prior art, the inflatable members are constructed of a foam core wholly surrounded by and bonded to a pair of thin skins or panels, which form a fluid tight envelope. A valve is disposed between the chamber formed by the envelope and the ambient environment. This innovation is critical to the proper functioning of my invention. Prior air pads have featured air chambers that were empty or enclosed a loosely fitting core of foam or some other material. Bonding the core to the outer walls of the chamber means that air entering and leaving the chamber must filter slowly through the foam core rather than rushing around its periphery. This, in turn, allows the air pad to provide valuable quasi-orthotic benefits. Thus, for example, after allowing inflation of an air pad of this type and inserting the air pad between saddle and horse, the valve can be opened. In this situation, the air pad will conform to the contours and configuration of both saddle and horse until it reaches a point where the pressure exerted by foam and air remaining in the foam matches the exterior pressure placed on its various parts. The valve is then closed. When the air pad is removed and examined, it will be seen to have taken a shape and configuration conforming to the contours and configuration of horse and saddle. If the valve remains closed, the air pad will retain this orthotic configuration for an extended period of time. Yet, it is relatively flexible and remains capable of adjusting as necessary to the turning and active movements of the horse and the shifting movements of the load being carried.

Even given the innate benefits of my design as set forth above, I have also found that the inclusion of proportional valves is extremely advantageous for the purposes of my invention. The proportional valve of my invention is, generally speaking, a spring-loaded valve that can be adjusted to different degrees of tightness. At its tightest setting, only a heavy load (or rider) will be sufficient to displace the spring-biased plug for the valve and allow air to exit the pad. At its lightest setting, the moderate pressure exerted on the air pad by a light load (or rider) will accomplish this result. The inclusion of proportional valves allow my pads to function more efficiently with loads (or riders) of different weights. For example, with an ordinary valve, it is possible that a very heavy rider could compress the air pads almost completely over some critical pressure points. In this situation, the air pads would cease to function for their intended purpose in the most efficient manner. However, with proportional valves adjusted to a setting based on the rider's weight, this problem will not occur. The valves will not allow as much air to escape when a heavier load is placed on the air pads, preserving the cushioning function and quasi-orthotic benefits of my invention.

In addition to the advantages discussed above, the inclusion of proportional air valves has another important benefit: they are virtually automatic. Without such valves, it is necessary for the rider to initially open the air valves to allow air to escape from full air pads so that the air pads can assume the desired molded/orthotic configuration. The non-proportional air valves are then closed to fix the air pads in this configuration. (Usually this procedure is followed after initially cinching the saddle into place, re-cinching the saddle for tightness, and mounting the horse.) However, with a proportional air valve, the adjustment process becomes almost fully automatic. After initially setting the air valves for the desired load, the rider need take no further action. The air pads will let the desired amount of air escape automatically when the rider cinches the saddle into place and mounts.

In addition to the changes and improvements set forth above, I have found it very advantageous to form the pads of my invention from breathable moisture wicking materials that allow perspiration to freely evaporate and aid in cooling. I have also found it advantageous to form the surfaces of these pads from a breathable non-slip material that has never been used in this type of application. A material formed from a polyester mesh with polyvinylchloride (PVC) coating bonded to felt is ideal for this purpose. This material, which was previously used for making weightlifter's gloves, provides excellent non-slip traction for the pads of my invention without inhibiting the free flow of air and other desirable characteristics of the moisture wicking materials I use in making my pads. This non-slip material is currently produced and sold under the brand name TOUGH TEK. It is, in addition, very useful in creating non-slip straps for use with my invention.

The types of tough durable inflatable members preferred for use as air pads in my invention are presently produced by Cascade Designs, Inc. of Seattle, Wash., under the trademark THERM-A-REST. The nature of the inflatable members can be varied depending upon the environment in which the invention will be exposed. For example, the inflatable member can use a homogenous core such as the type disclosed in U.S. Pat. Nos. 4,624,877 and 4,025,974 or can use a composite core such as disclosed in U.S. Pat. No. 5,282,286, all of which are incorporated herein by reference. Moreover, other cores can be used as long as the core includes tensile elements therein that, when bonded to the pair of thin skins or panels, resist displacement of the skins when the pad is subject to compression. However, cores that slow the movement of air in, out, and through the pad are preferred.

DRAWINGS

Figure 6A:
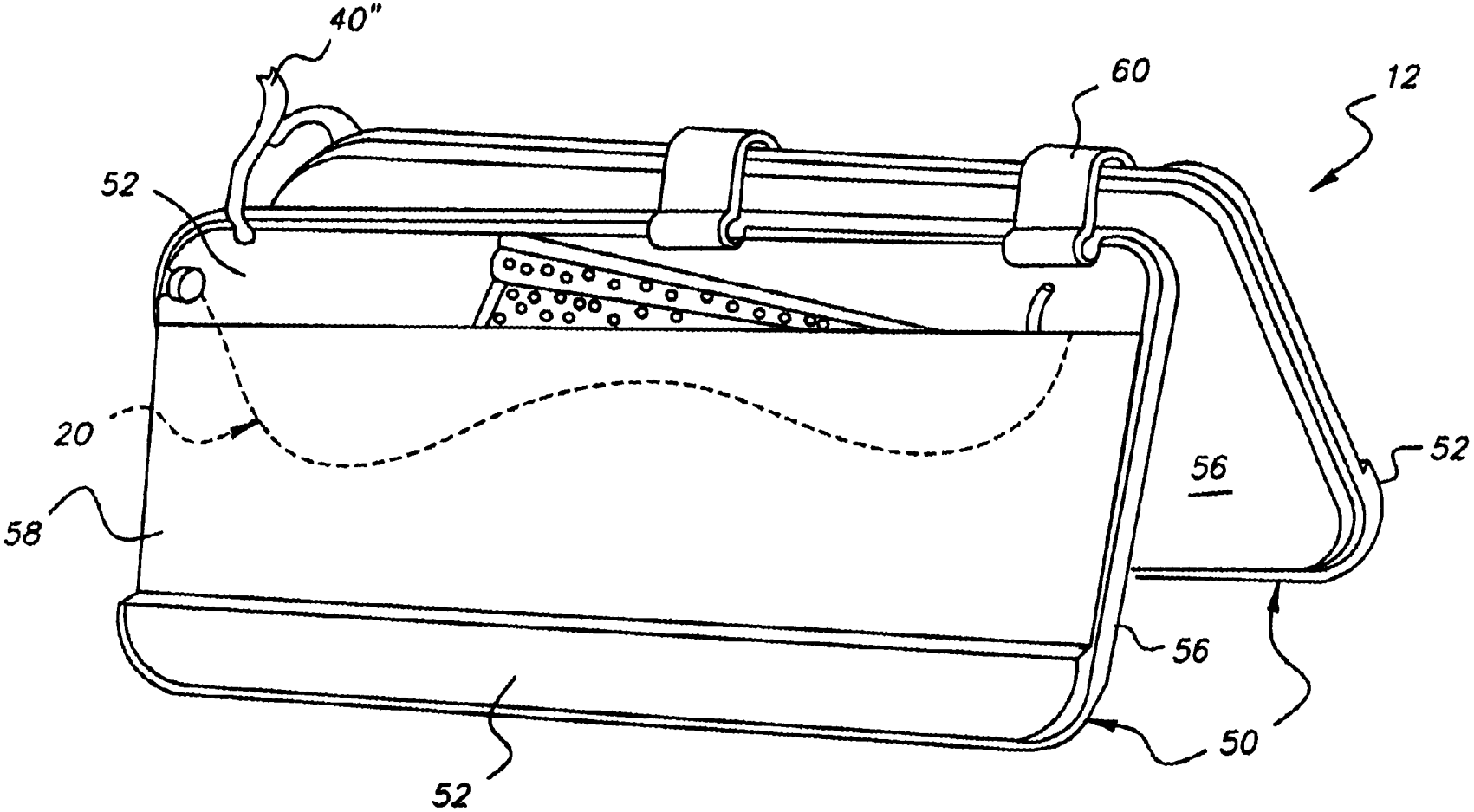
FIG. 6A shows the inflatable member of FIG. 5 disposed in one of two western style side pads adapted to receive a pair of inflatable members in pouches with VELCRO closure means.
Figure 6B:
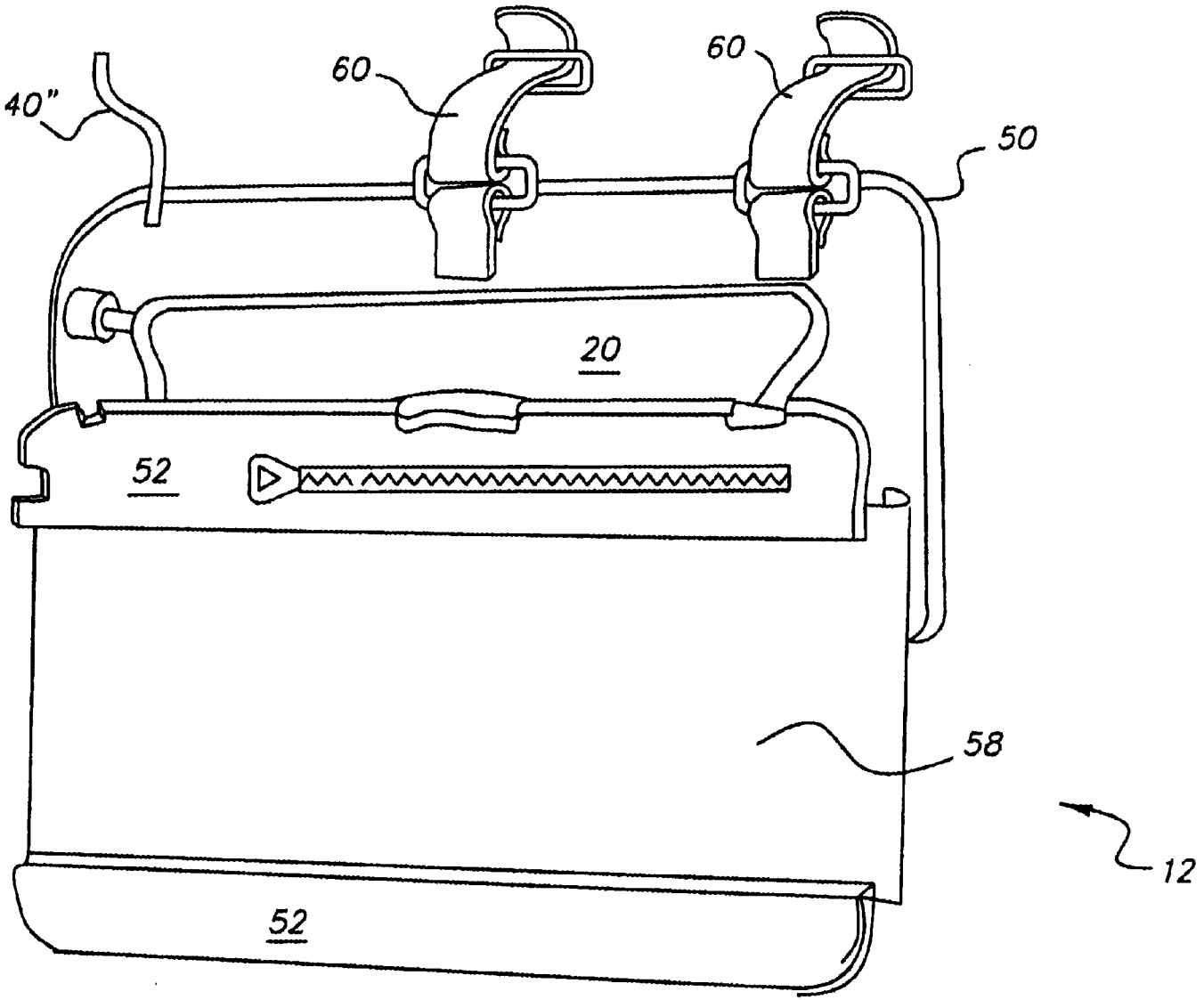

FIG. 6B provides an exploded perspective view of one western style side pad adapted to receive an inflatable member in a pouch using a zipper as a closure means.

Figure 7:
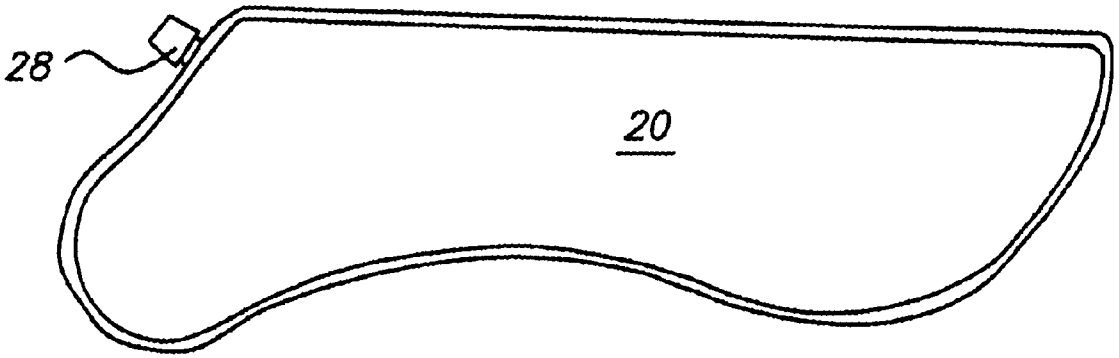

FIG. 7 is a side elevation view of one inflatable member that has been contoured to fit the tree of an English style saddle.

Figure 8:
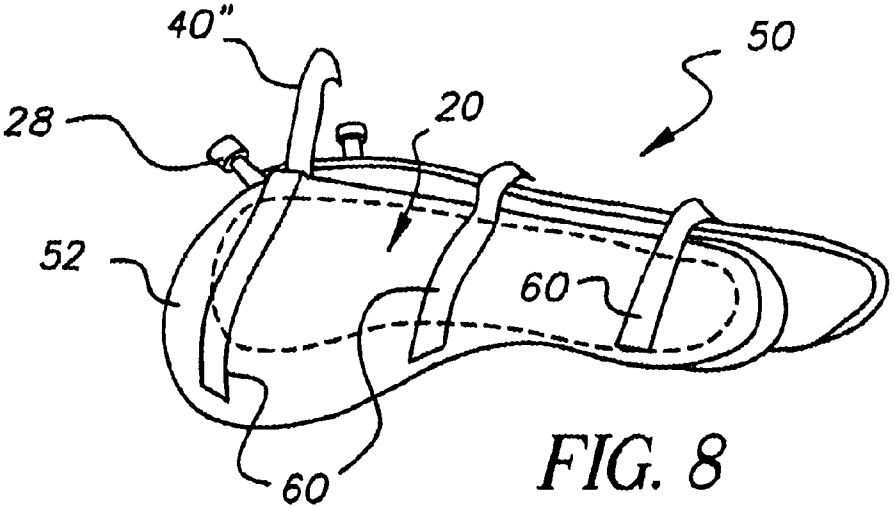

FIG. 8 shows the inflatable member of FIG. 7 disposed in an English style pad adapted to receive a pair of inflatable members.

Figure 9A:
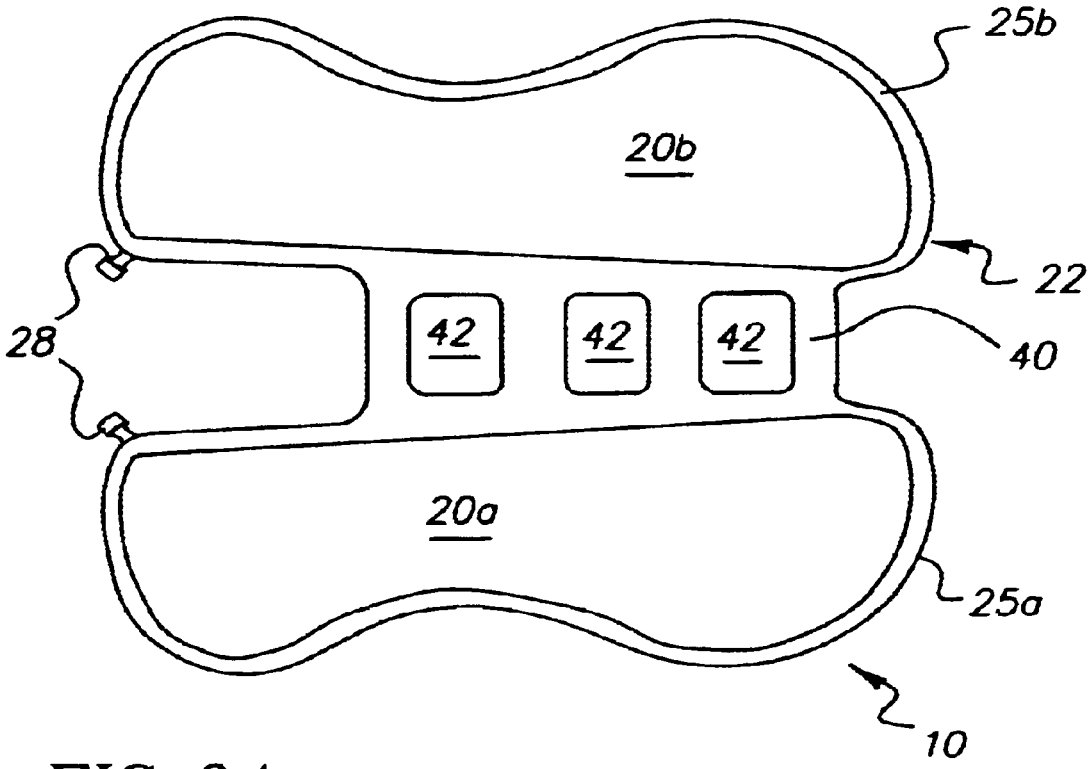

FIG. 9A is a plan view of an alternative pad embodiment wherein the two inflatable members are formed by common outer skins and linked by a web portion.

Figure 9B:
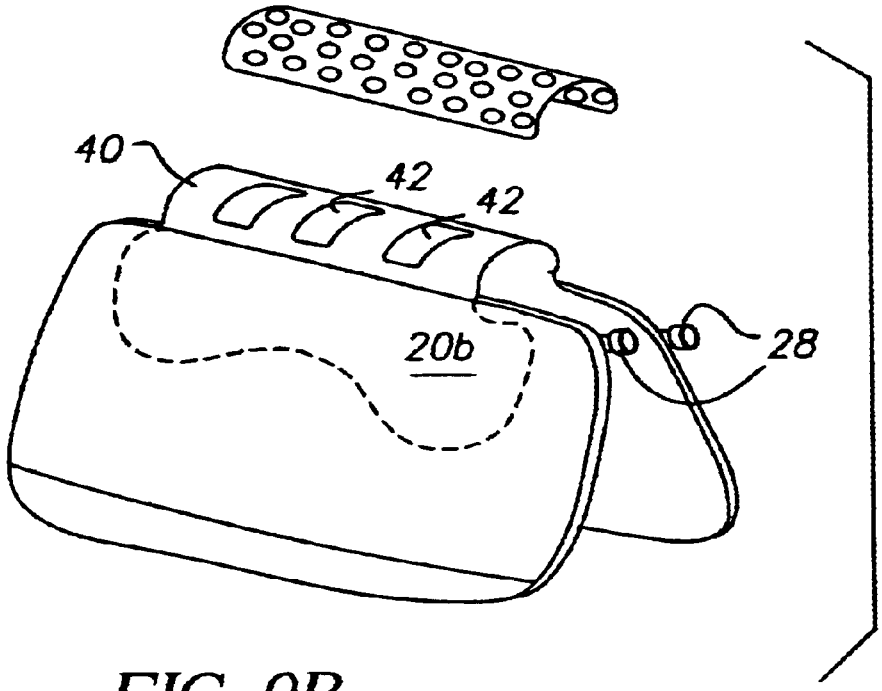

FIG. 9B is a perspective view of the embodiment shown in FIG. 9 wherein the inflatable members have been disposed in a pad adapted to receive the inflatable members.

Figure 10A:
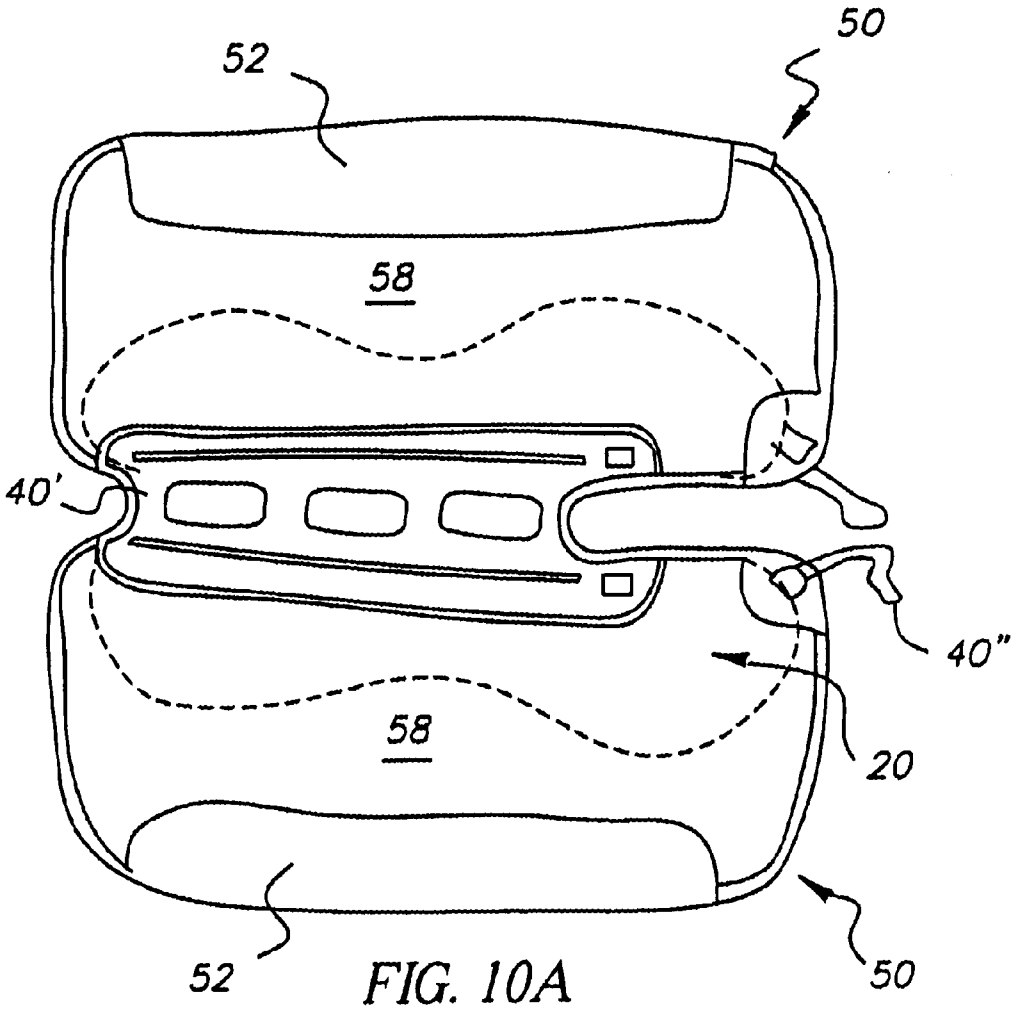

FIG. 10A provides a view from above of an embodiment for use with a western saddle having receiving structures that are joined by a fixed web at the rear and that have an open front end with an optional adjustable strap for positioning adjacent the horse's withers.

Figure 10B:
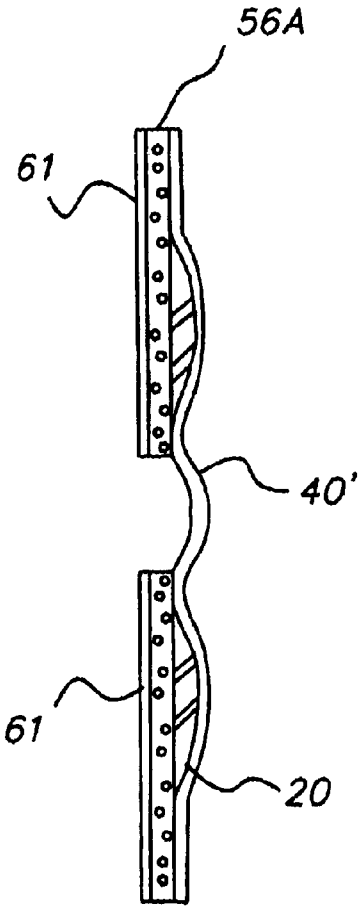

FIG. 10B provides a cross-sectional view of the embodiment illustrated in FIG. 10A.

Figure 10C:
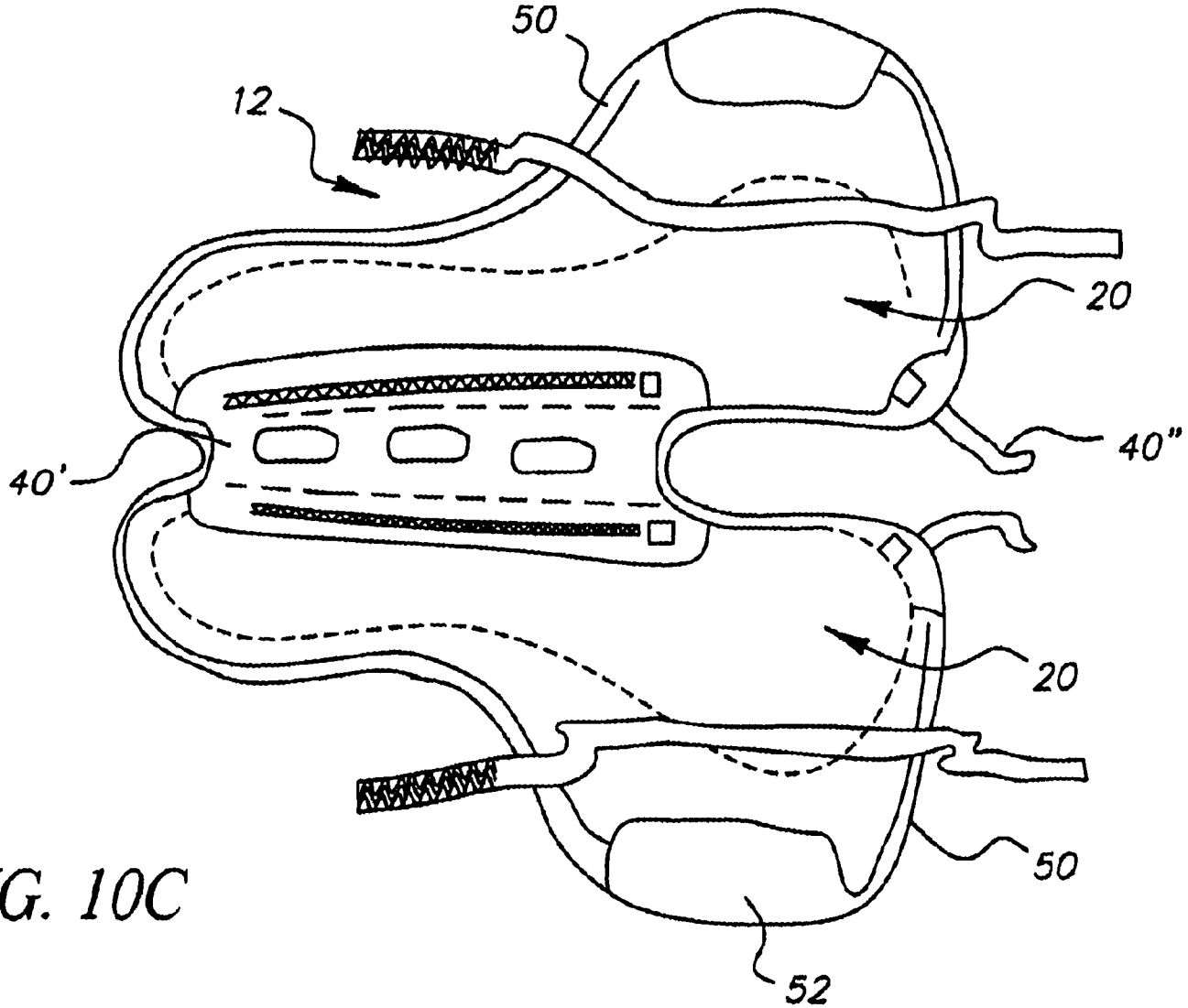

FIG. 10C provides a view from above of an embodiment for use with an English saddle having receiving structures that are joined by a fixed web at the rear and that have an open front end with an optional adjustable strap for positioning adjacent the horse's withers.

Figure 10D:
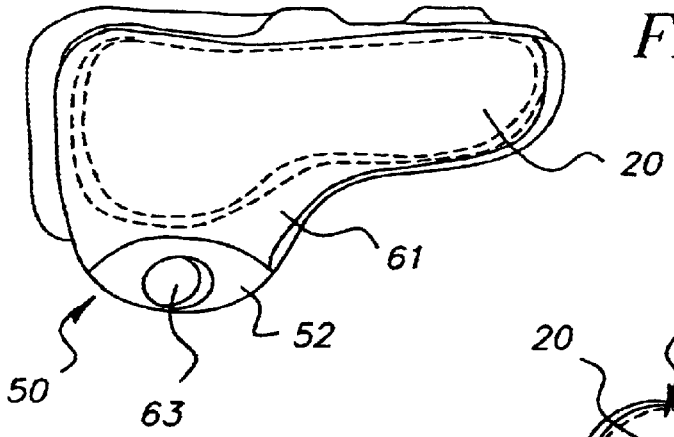

FIG. 10D provides a side view of an embodiment for use as a bareback saddle having means in the form of an aperture for receiving a strap and also has ties for making an adjustable connection over the animal's withers.

Figure 10E:
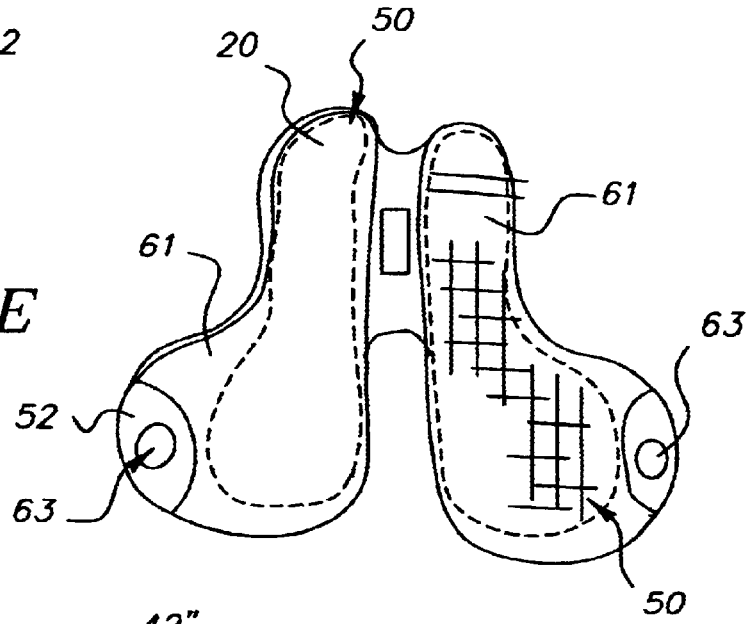

FIG. 10E provides a view from above of the embodiment shown in FIG. 10D.

Figure 10F:
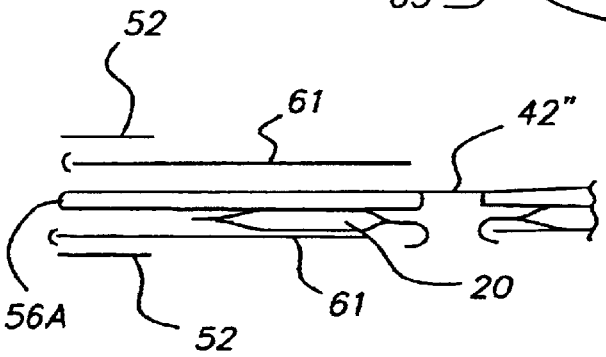

FIG. 10F provides an exploded schematic cross-sectional view of one of the receiving structures shown in FIGS. 10D and 10E, illustrating the placement of various materials therein.

Figure 10G:
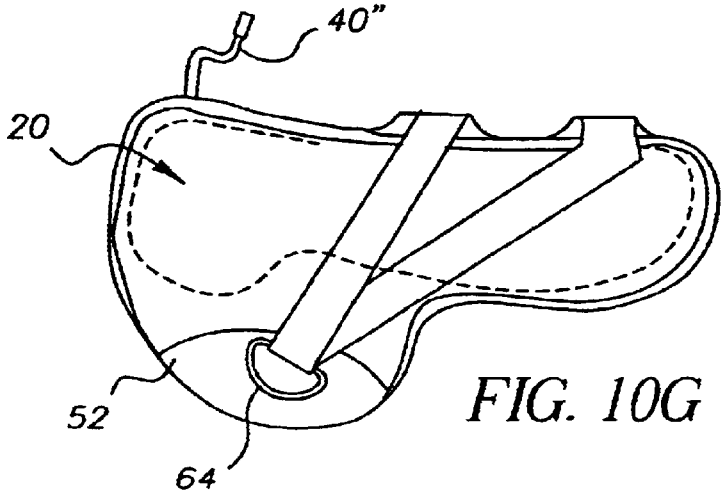

FIG. 10G provides a side view of an embodiment for use as a bareback saddle having means in the form of a "D" ring for receiving a strap.

Figure 10I:
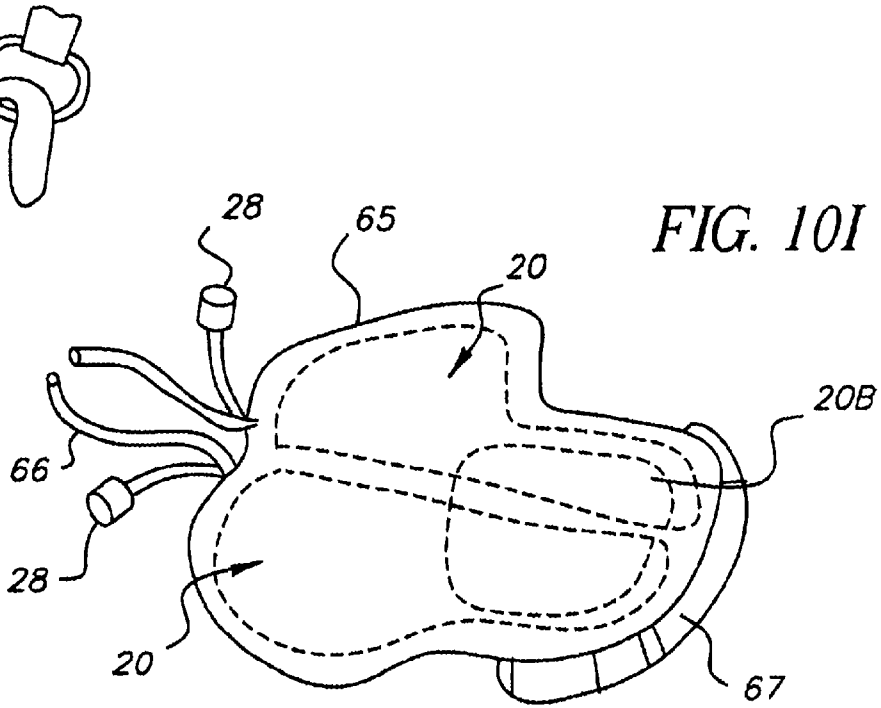
Figure 10H:
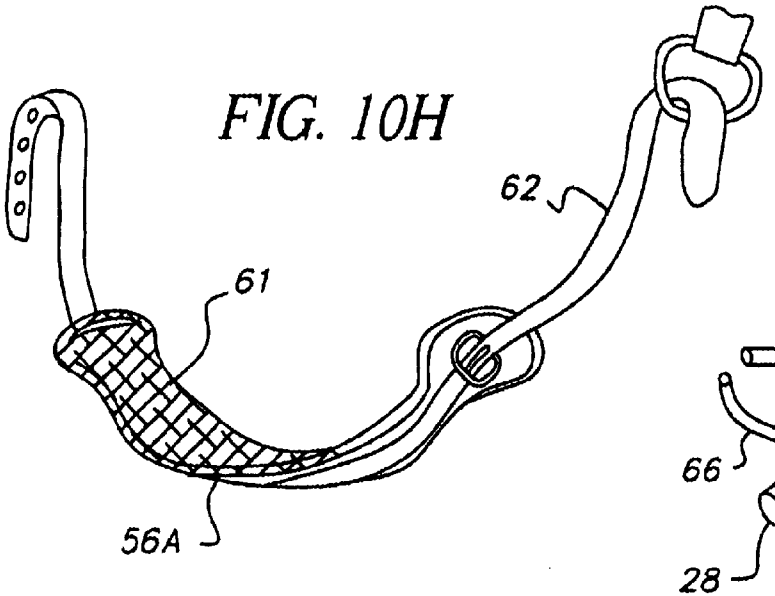

FIG. 10H provides a perspective view of a strap incorporating the teachings of this invention.

FIG. 10I provides a view from above of a rider pad intended for placement between a rider and saddle.

Figure 10J:
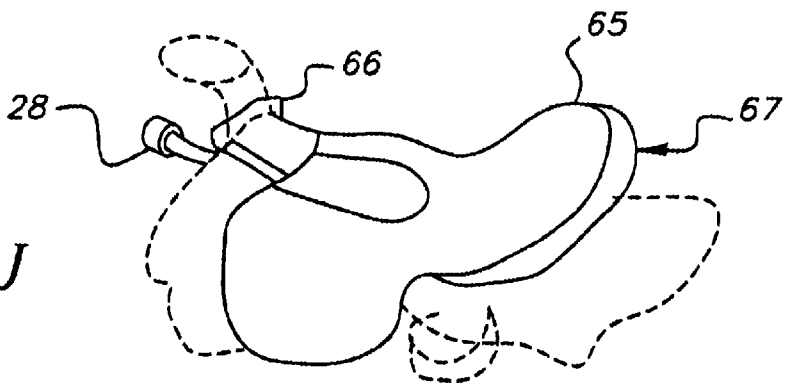

FIG. 10J provides a perspective view of the rider pad of FIG. 101 in place on a saddle.

Figure 11:
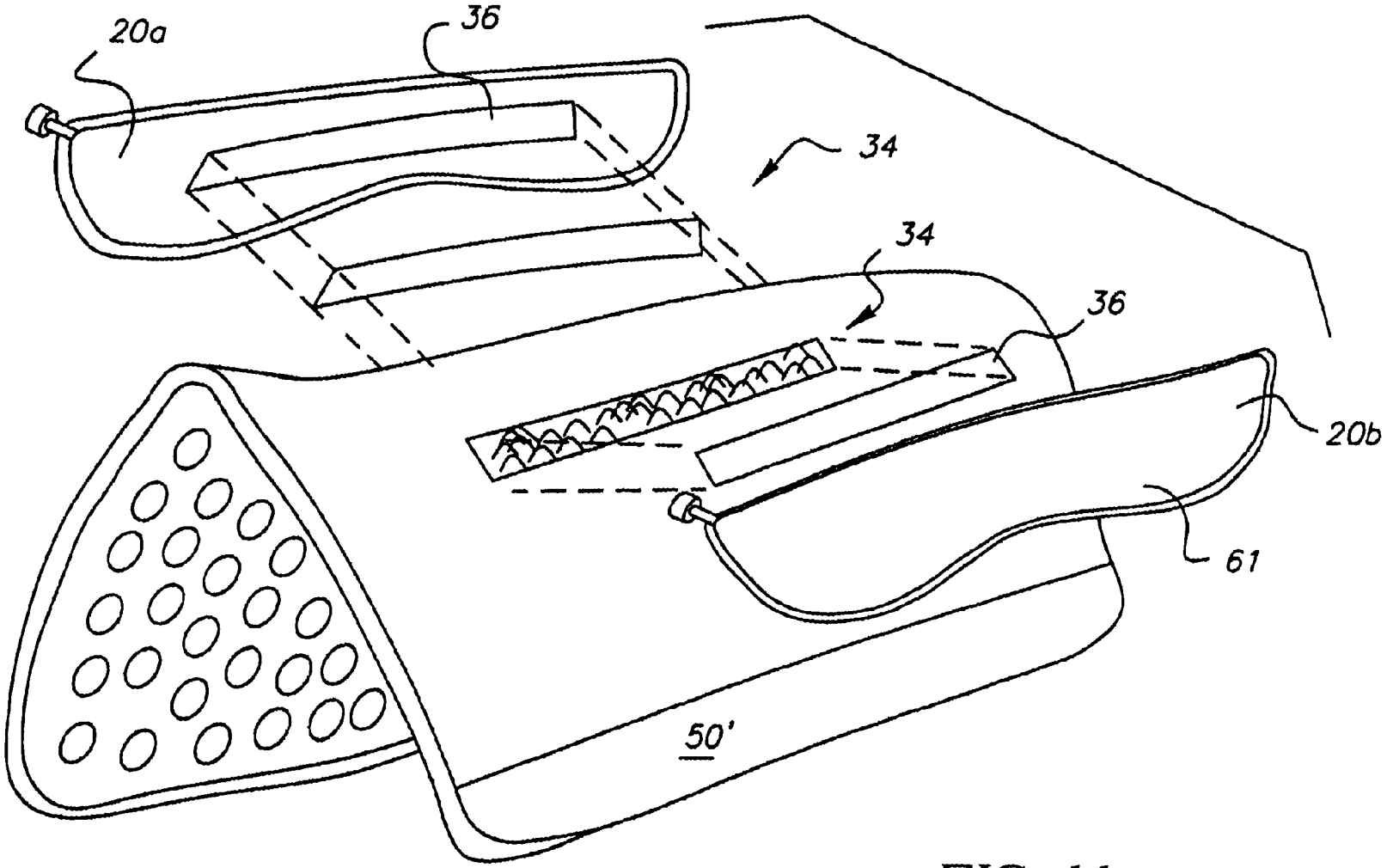

FIG. 11 is a partially exploded perspective view of an alternative embodiment wherein each inflatable member is directly attached to a blanket by way of a two-part fastening system.

Figure 12B:
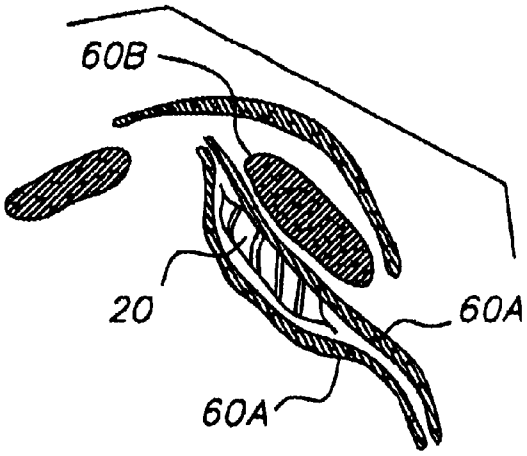
Figure 12C:
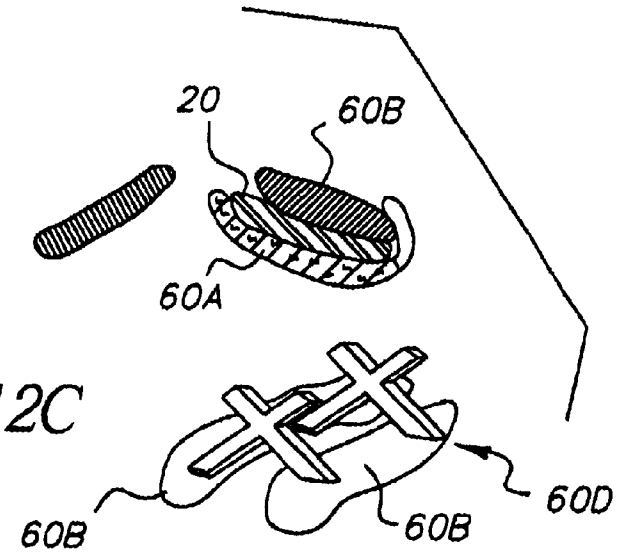
Figure 12A:
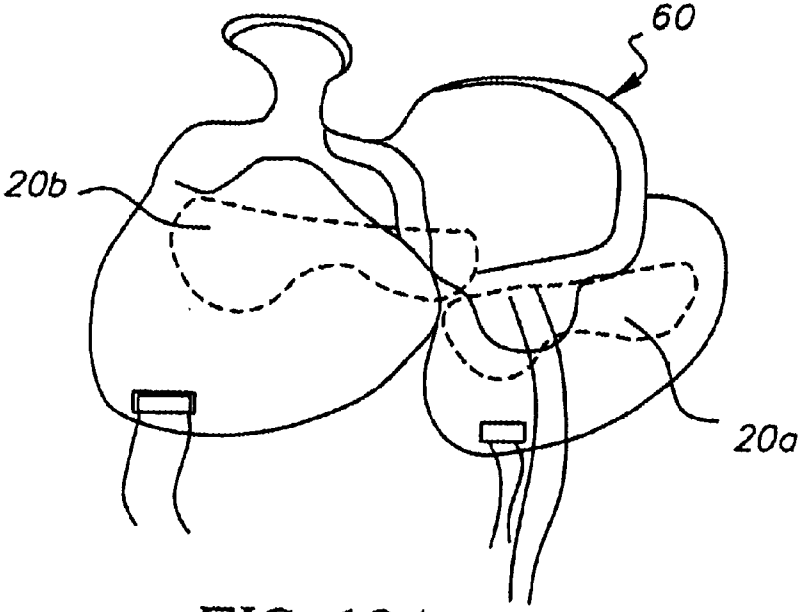

FIG. 12A provides a perspective view of a western saddle with inflatable members incorporated into the saddle and held in place between other saddle members under the saddle tree.

FIG. 12B provides a partial cross-sectional view of the embodiment illustrated in FIG. 12A.

FIG. 12C provides a perspective view and partial cross-sectional view of an embodiment with inflatable members incorporated into a packsaddle.

Figure 13A:
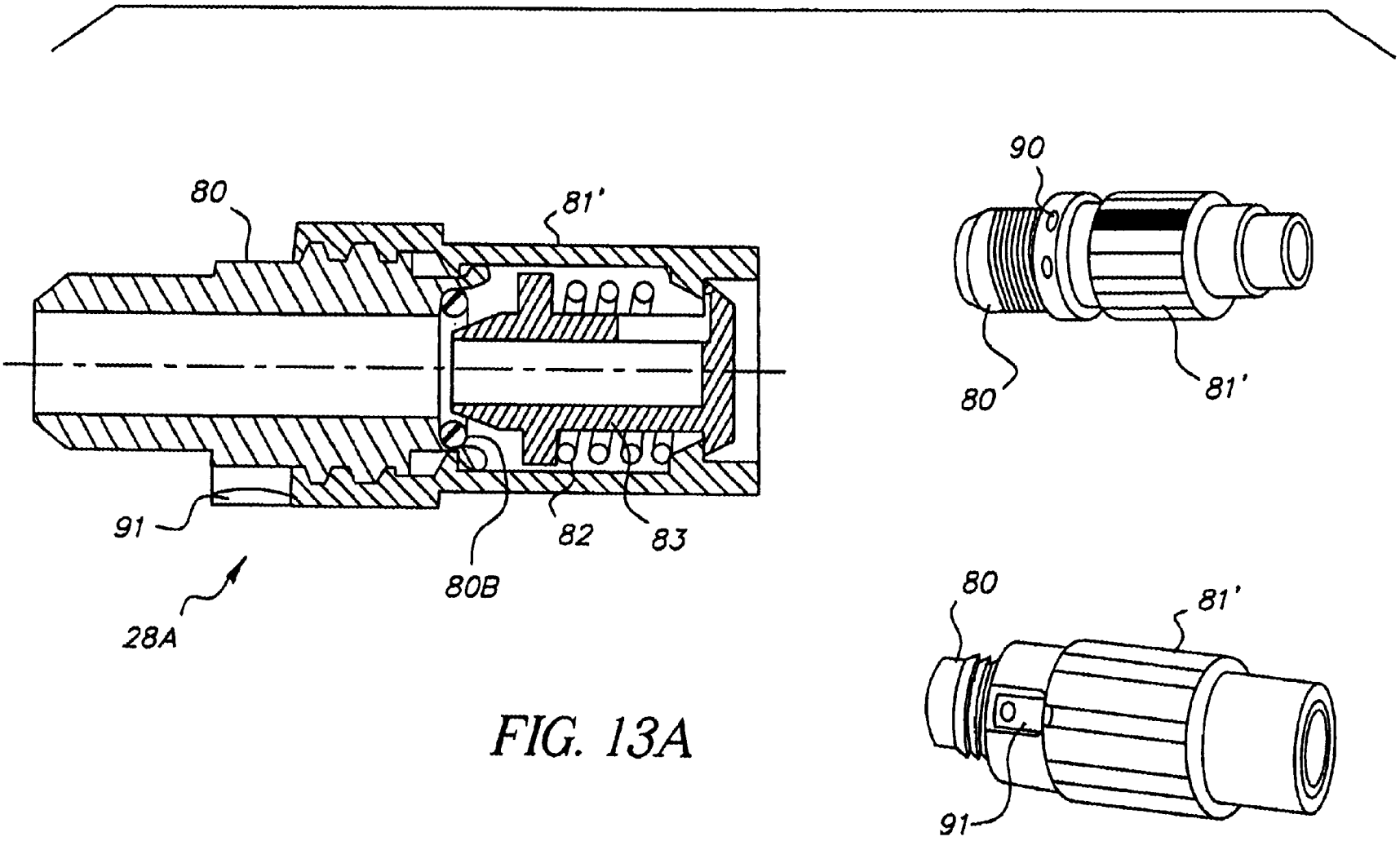

FIG. 13A provides a cross-sectional view of a proportional valve, while details X and Y therefrom provides perspective views illustrating two indicator arrangements therefor.

Figure 13B:
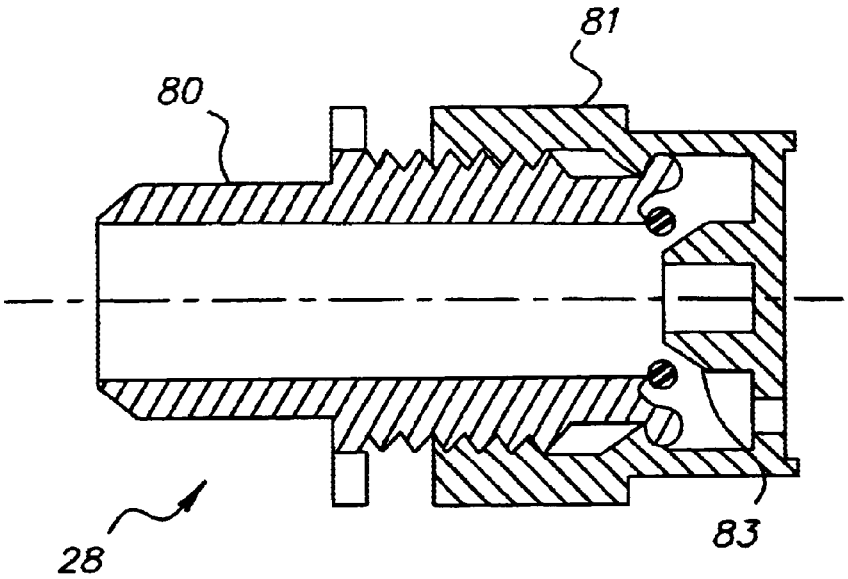
FIG. 13B (PRIOR ART)

FIG. 13B provides a cross-sectional view of an ordinary valve suitable for use with this invention.

Figure 13C:
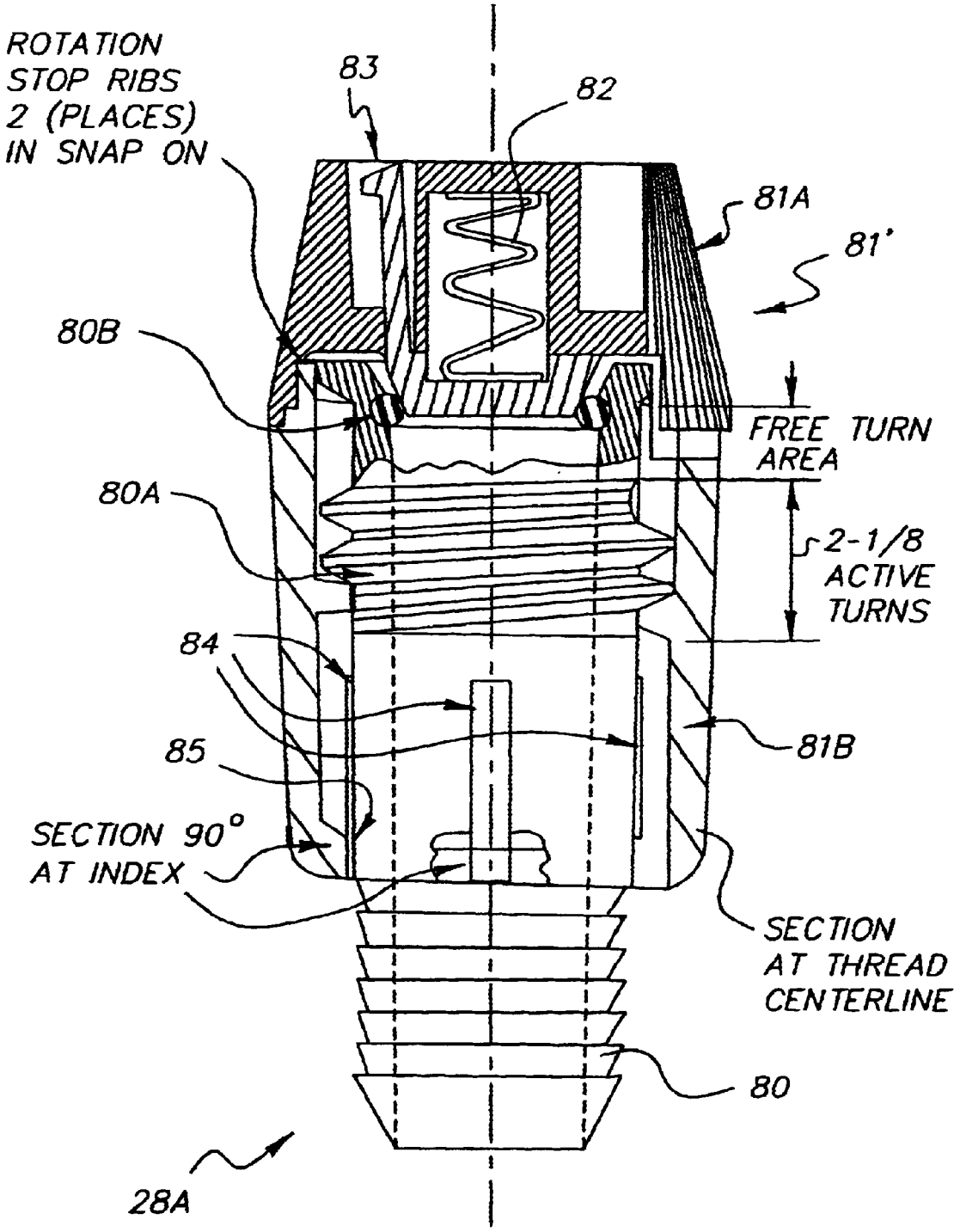

FIG. 13C provides a cross-sectional view of another proportional valve.

Figure 13D:
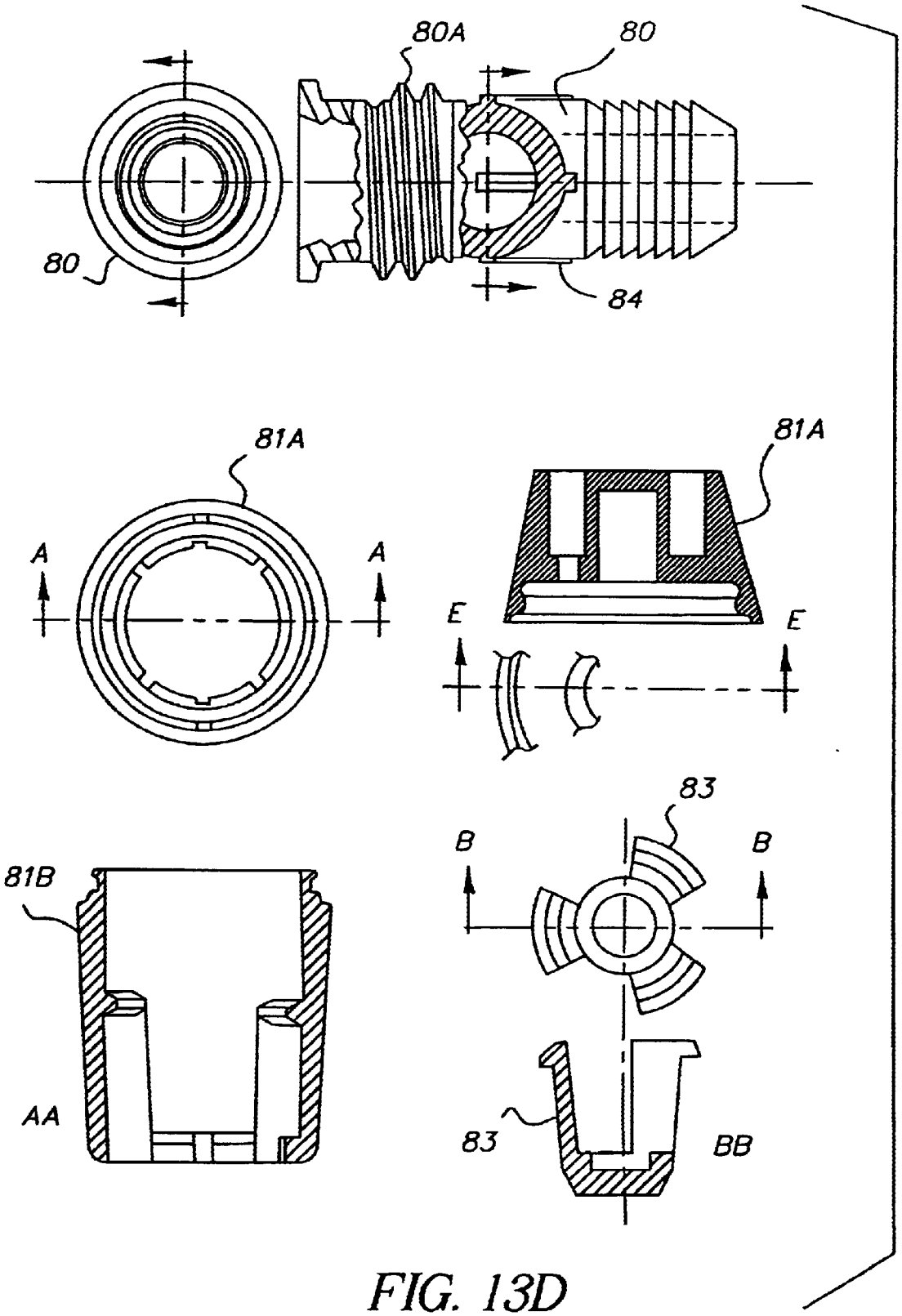

FIG. 13D provides details related to the proportionate valve illustrated in FIG. 13C.

Figure 14:
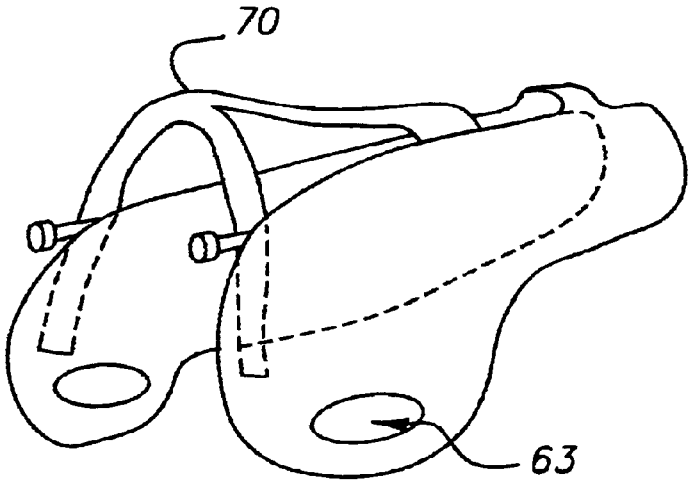

FIG. 14 provides a perspective view of an embodiment for use as a bareback saddle having a forward hand-hold formed by a connector bridging the animal's withers.

DETAILED DESCRIPTION

The following discussion is presented to enable a person skilled in the art to make and use the invention. Various modifications to the preferred embodiment will be readily apparent to those skilled in the art, and the generic principles herein can be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein.

Figure 1:
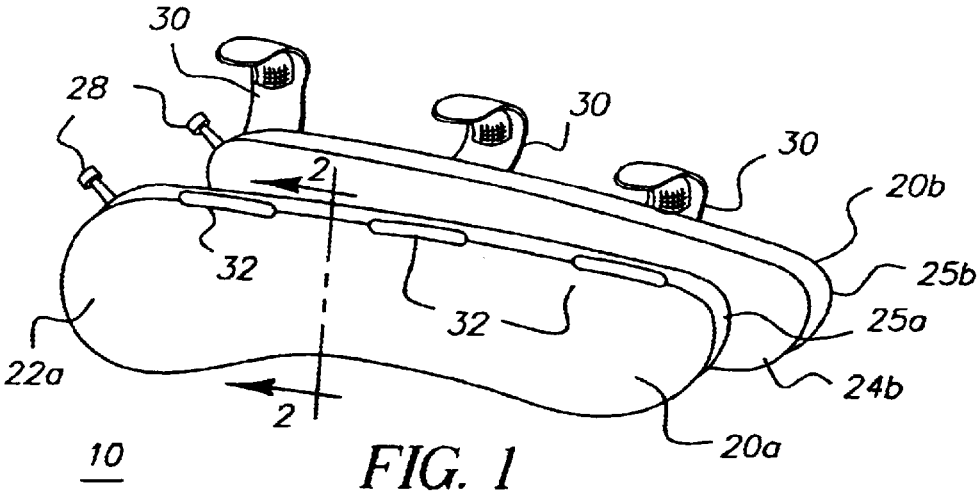
FIG. 1 is a perspective view of a pad embodiment wherein the two inflatable members are linked by auxiliary straps or clips.
Figure 2:
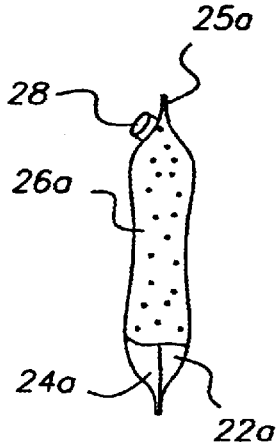
FIG. 2 is a partial cross section elevation view of the embodiment shown in FIG. 1.

Turning then to the several Figures, and more particularly to FIGS. 1 and 2, a basic form of a preferred embodiment is shown. Each pad system 10 comprises a pair of inflatable members 20*a* and 20*b* linked by a connection means forming a top connection. In these figures, the connection means comprises straps 30, which interact with slots 32. While the particulars associated with the connection means will be described in more detail below, the following paragraphs provide detail regarding inflatable members 20.

Each inflatable member 20 has a foam core wholly surrounded by and bonded to a pair of outer panels (or thin skins) 22*a* and 22*b*, and 24*a* and 24*b*, which form a fluid tight envelope. Valve 28 is disposed between the chamber formed by the envelope and the ambient environment. Preferably, the construction of each member 20 is accomplished by coating one side of each outer panel 22*a* and 22*b*, and 24*a* and 24*b*, with a thermoplastic material, placing respective cores 26*a* and 26*b* between the coated panels, compressing the assembly under heat to cause portions of the cores to bond with portions of the panels, sealing the perimeters 25*a* and 25*b* of the panels adjacent to the core to one another while including one valve 28 for each formed envelope. Further disclosure regarding this technology can be found in U.S. Pat. Nos. 4,624,877 and 4,025,974, which again are incorporated herein by reference.

Selection of the components that comprise each inflatable member 20 should be made in view of the environment in which pad system 10 will be used. If an inflatable member 20 is to be used without integration into an existing pad or blanket, then outer panels 22*a* and 22*b*, and 24*a* and 24*b*, should be durable and should be capable of collecting moisture (i.e.-have water-wicking capabilities) and disbursing it by evaporation. This quality can be provided by adding a layer of water-wicking material to the outer surface(s) of the inflatable member 20. If inflatable member 20 will be subjected to non-uniform loads (particularly point loading), it may be beneficial to use a heterogeneous core having various Indentation Force Deflection value elements as taught in U.S. Pat. No. 5,282,286, which is again incorporated by reference herein.

Figure 5:
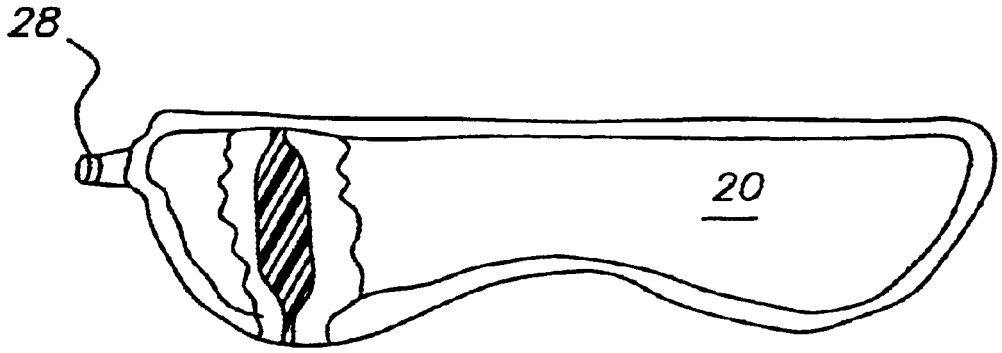
FIG. 5 is a side elevation view of one inflatable member that has been contoured to fit the saddletree of a western style saddle.

Each inflatable member 20 is preferably a custom-formed THERM-A-REST style self-inflating pad. The custom formation is directed primarily to the intended interface of the system. Thus, if a western saddle is contemplated, then each member 20 will have perimeter contours for the saddletree of such a saddle. (See, e.g., FIGS. 5 and 6.) If an English saddle is contemplated, then each member 20 will have perimeter contours for the saddletree of such a saddle, as is best shown in FIGS. 7 and 8. Although preferred, adaptation of the invention to suit the intended saddletree is not required.

Figure 3A:
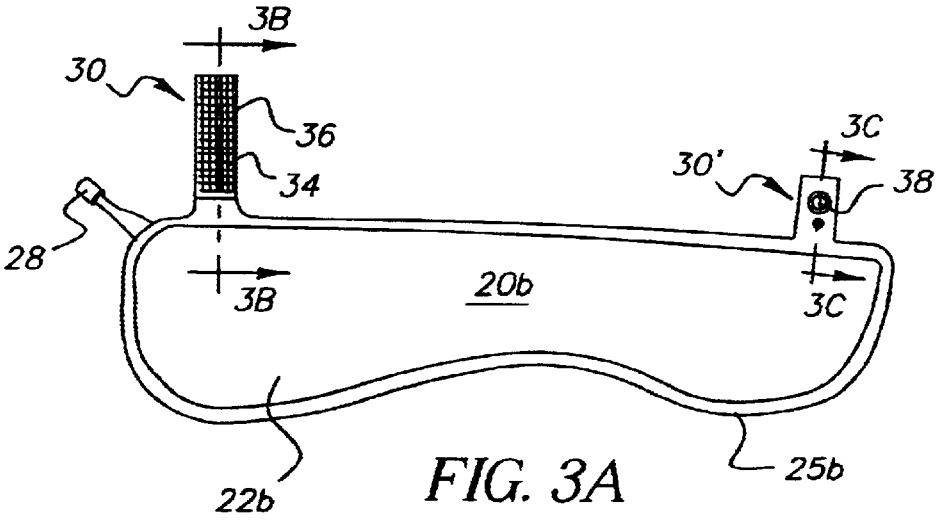
FIG. 3A is an elevation view of one inflatable member, illustrating both a hook and loop, and a snap fastener that comprise a means for connecting the inflatable members.
Figure 3C:
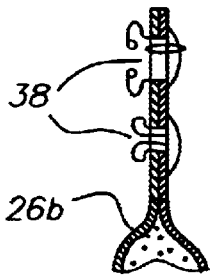
FIG. 3C is a partial cross section elevation view of the hook and loop fastener.
Figure 3B:
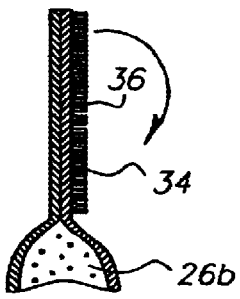
FIG. 3B is a partial cross section elevation view of the snap fastener.
Figure 4:
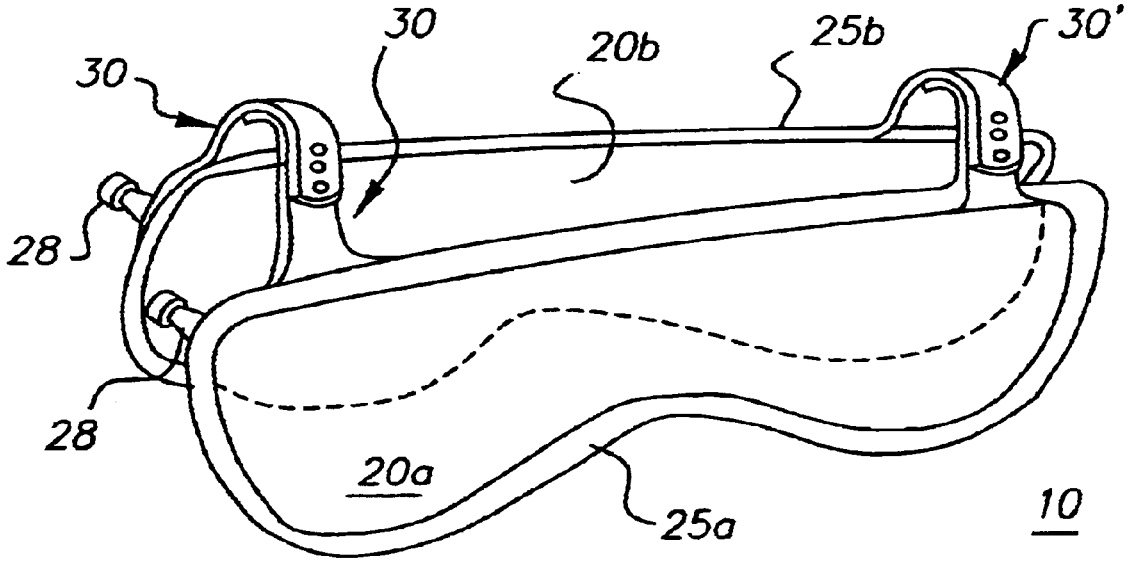
FIG. 4 is a perspective view of the embodiment shown in FIG. 3A wherein the two inflatable members are linked.

Versatility of the various embodiments according to the invention is enhanced by employing a variety of means for connecting inflatable member 20*a* to inflatable member 20*b*. As illustrated in FIGS. 1–4, the means for connecting member 20*a* to member 20*b* can be accomplished by way of adjustable length straps. In FIG. 1, straps 30 are integrated into inflatable member 20*a* and loops or slots 32 are formed in perimeter 25*a* of inflatable member 20*a*. Once passed through the slots, the straps, having hook material 34 and loop material 36 attached thereto, are turned back on themselves and self-engaged as is best shown in FIG. 3B. An alternative arrangement is shown in FIG. 3A wherein button snaps 38 are used on strap 30'. (It should be noted that strap length adjustability is minimized with the use of button snaps; however, durability and security are enhanced.) It is further possible to dispense with slots 32 and create a mirror image pad 20 as shown in FIG. 4. In this embodiment, both pads 20*a* and 20*b* have straps 30 and 30' and engage as shown in this figure. Naturally, any connecting means, whether flexible (e.g. nylon webbing) or generally rigid (e.g. plastic clips), that mechanically links one member to the other will meet the requirements of the connecting means.

Yet another alternative connecting means is shown in FIGS. 9A and 9B. Here, the connecting means is not an auxiliary structure integrated or attached to each member 20, but is a web portion 40 formed from the outer panels. While earlier embodiments identified discrete panels 22*a* and 22*b*, and 24*a* and 24*b*, a single panel 22 is mated to a single panel 24 (the obverse side of panel 22 and not shown in this figure) whereby inflatable members 20*a* and 20*b* are linked by their common panels 22 and 24. To facilitate desirable ventilation, a plurality of holes 42 are formed in web portion 40, which is considered the connecting means. FIGS. 10A through 10C provide a sequence of views for embodiments joined by a fixed web 40' at the rear that is largely open with an adjustable strap 40" at the front end for positioning adjacent the horse's withers.

To form saddle pad system 12, it is generally necessary to establish a receiving structure for receiving each inflatable member 20. Such a system is shown in FIGS. 6A, 6B, 10A, 10B, and 10C wherein inflatable members 20 are inserted into pockets in receiving structures 50 to form saddle pad system 12. By establishing a saddle pad system 12, the benefits associated with each approach are realized as will be appreciated by those persons skilled in the art. In particular, receiving structures 50 provide inflatable members 20 with increased protection from the elements, provide the animal with greater comfort, and positively locate inflatable members 20 on the animal so as to minimize unintentional dynamic changes that might otherwise occur during use. They can also be made to conform to a shape appropriate for a particular equine activity such as one of show riding, dressage riding, endurance riding, western riding, bareback riding, and English riding. In addition, inflatable members 10 are easily removable for cleaning, repair, or replacement. Finally, the presence of said pockets provides a location where magnets can be inserted if desired for their therapeutic effects.

Receiving structures 50 have durable strips 52 of leather for high wear areas; a horse-facing side 56 of felt 56A for cushioning, air passage, and sweat removal; a saddle-facing side 58 of felt 56A or other similar material for sweat absorption, heat passage, air passage, and evaporation; and straps 60 or an alternate top connection so as to form saddle pad system 12. Regardless of the composition of receiving structures 50, it is primarily necessary that they define a suitably sized and positioned pocket for receiving an inflatable member 20 when saddle pad system 12 is placed on a load-bearing animal. In order to ensure that system 12 maintains its proper position, I have found that it is very desirable to apply a breathable non-slip material 61 to the surfaces of receiving structures 50. This material can advantageously be formed from a polyester mesh with polyvinylchloride (PVC) coating bonded to felt and is ideal for this purpose when positioned with its mesh side facing outward. It provides excellent nonslip traction for the saddle pad system 12 of my invention without inhibiting the free flow of air and other desirable characteristics of the resilient moisture wicking material (wood-based felt) I use in making my pads. This non-slip material 61 is currently produced and sold under the brand name TOUGH TEK. It is, in addition, very useful in creating non-slip straps 62 for use with my invention as illustrated in FIG. 10H.

Further, as illustrated in FIGS. 10D through 10G and FIG. 14, my invention can be configured as a bareback pad (with the addition of means—such as a strap 62 of the type shown in FIG. 10H—to hold it in position on the horse). Optionally, it can be provided with some point of attachment such as an aperture 63 or a "D" ring 64 for use with an existing strap. It can also have a connector 70 adapted to bridge the animal's withers and serve as a hand hold. As illustrated in FIGS. 10I and 10J, my invention can also be configured as a rider pad 65 with the addition of means to hold it in position on a saddle. Such means can take the form of a strap or loop 66 that can fasten around the horn of a saddle and an elastic cantle attachment 67 for fastening at the rear of the saddle. (In this option, an inflatable member can be used to form a single butt pad 20B for use with or without other such members.)

Still another embodiment locates inflatable members 20*a* and 20*b* on the exterior of a user's pad as shown best in FIG. 11. In this embodiment, existing saddle pad or blanket 50' is retrofitted to conveniently receive inflatable members 20*a* and 20*b*. As illustrated, one part of a two-part attachment system, such as hook material 34, is permanently attached to each side of blanket 50'. Complementary loop material 36 is permanently attached to panels 24*a* and 24*b* of inflatable members 20*a* and 20*b*, respectively. When mated, each member 20 is semi-permanently attached to blanket 50'. As with other illustrated embodiments, the fasteners can be attached to the panel body of member 20 or can be attached to the perimeter panel sections 25, i.e. where the opposing panels are directly bonded to one another and have minimal sectional thickness.

My invention can also be constructed as an integral part of the saddle. An example is provided in FIG. 12A, which provides a perspective view of a western saddle 60 with inflatable members 20*a* and 20*b* incorporated into the saddle 60 and held in place between other saddle members 60A under the saddle tree 60B. FIG. 12B provides a partial cross-sectional view of the embodiment illustrated in FIG. 12A, while FIG. 12C provides a perspective view and partial cross-sectional view of an embodiment with inflatable members 20*a* and 20*b* incorporated into a pack saddle 60D.

In whatever manner my invention is constructed, it is advantageous to use proportionate valves 28A for valves 28. A proportionate valve 28A can be a spring-loaded valve of the type illustrated in FIGS. 13A, 13B and 13D. An ordinary valve 28 as illustrated in FIG. 13B has a valve body 80 with a threaded portion 80A on which is mounted a rotating member, screw cap 81. The valve 28 is not adjustable; it can merely be opened or closed by turning screw cap 81. A proportionate valve 28A can, however, be adjusted to different degrees of tightness by rotation of modified screw cap 81'. This is made possible by the inclusion of a biasing spring 82 in proportionate valve 28A and other modifications thereto as shown in FIGS. 13A through 13C. At its tightest setting, only a heavy load (or rider) will be sufficient to displace the spring-biased plug 83 and allow air to escape. At its lightest setting, the moderate pressure exerted on the air pad by a light load (or rider) will accomplish this result. Detailed perspective views illustrating a line-up indicator 90 arrangement and illustrating a window 91 scale in FIG. 13A show two manners in which settings for proportionate valve 28A can be made. FIGS. 13C and 13D illustrate an embodiment having four snap members 84 that snap into two indents 85 when modified screw cap 81' is turned. Modified screw cap 81' has an upper part 81A and a lower part 81B attached by screw-threaded portion 80A to a valve body 80 with an O-ring 80B. The snap members 84 of this embodiment not only act as an indicator of pressure setting, but help to stabilize and prevent undesired rotation of the rotating member/screw cap 81' for this embodiment. They thereby stabilize and prevent unintended change in the pressure setting for the proportionate valve 28A.

I claim:

1. A load pad for a load-bearing animal, comprising:

a left inflatable member adapted for placement between a left upper side of the load-bearing animal and a load resting on that side, the left inflatable member having a foam core with a cell structure that absorbs atmospheric air, which foam core is wholly surrounded by and bonded to a thin skin which forms a fluid tight envelope around said foam core, which thin skin has an opening for transmitting air between the foam core and the atmosphere, which transmission of air is controlled by a left inflatable member valve in said opening;

a right inflatable member adapted for placement between a right upper side of the load-bearing animal opposite said left side and a load resting on that side, the right inflatable member having a foam core with a cell structure that absorbs atmospheric air, which foam core is wholly surrounded by and bonded to a thin skin which forms a fluid tight envelope around said foam core, which thin skin has an opening for transmitting air between the foam core and the atmosphere, which transmission of air is controlled by a right inflatable member valve in said opening; and a top connection adapted for linking said left inflatable member and said right inflatable member across an upper portion of the load-bearing animal such that said left inflatable member and said right inflatable member hang over said upper portion adjacent, respectively, the left and right upper sides of the load-bearing animal.

2. A load pad for a load-bearing animal as described in claim 1, wherein each inflatable member is shaped to conform to and pad portions of a load resting on that inflatable member's side of the load-bearing animal.

3. A load pad for a load-bearing animal as described in claim 2, wherein the load includes a saddle having a saddle tree and said inflatable members are shaped to conform to and pad portions of the saddle tree resting on the sides of the load-bearing animal.

4. A load pad for a load-bearing animal as described in claim 1, wherein a portion of an inflatable member forms a portion of the top connection.

5. A load pad for a load-bearing animal as described in claim 1, wherein air cannot enter or exit cells of the foam cores distant from the valve by which air is transmitted to said foam cores except by filtering through the interior of the foam cores.

6. A load pad for a load-bearing animal as described in claim 1, wherein said inflatable members act as orthotics.

7. A load pad for a load-bearing animal as described in claim 1, wherein said inflatable members are constructed in such a manner that the movement of air within the foam cores of the inflatable members is slowed.

8. A load pad for a load-bearing animal as described in claim 1, wherein the amount of air in the inflatable members is adjusted for a particular load by substantially inflating said members prior to placing a load thereon, allowing air to leave said members after placing a load thereon until equilibrium is reached, and closing said valves to prevent further loss of air from said inflatable members.

9. A load pad for a load-bearing animal as described in claim 1, wherein said valve is a proportionate valve, the proportionate valve being adjustable to different pressure settings, which different pressure settings allow air to escape from the valve until the set pressure is reached.

10. A load pad for a load-bearing animal as described in claim 1, wherein neither the inflatable members nor the top connection substantially contact a supraspinous ligament of the load-bearing animal.

11. A load pad for a load-bearing animal as described in claim 1, wherein an open gullet channel is maintained proximate a supraspinous ligament of the load-bearing animal.

12. A load pad for a load-bearing animal as described in claim 1, wherein neither the inflatable members nor the top connection contact the load-bearing animal's withers.

13. load pad for a load-bearing animal as described in claim 1, further comprising receiving structures holding said left inflatable member and said right inflatable member.

14. A load pad for a load-bearing animal as described in claim 13, wherein the top connection is provided by portions of the receiving structures.

15. A load pad for a load-bearing animal as described in claim 13, wherein a saddle pad provides said receiving structures.

16. A load pad for a load-bearing animal as described in claim 13, wherein a saddle provides said receiving structures.

17. A load pad for a load-bearing animal as described in claim 13, wherein the areas covered by said receiving structures conform to a shape appropriate for a particular equine activity such as one of show riding, dressage riding, endurance riding, western riding, bareback riding, and English riding.

18. A load pad for a load-bearing animal as described in claim 13, wherein said receiving structures are formed from breathable moisture wicking materials.

19. A load pad for a load-bearing animal as described in claim 18, wherein said breathable moisture wicking materials are also resilient.

20. A load pad for a load-bearing animal as described in claim 13, wherein a non-slip breathable material forms a surface portion of the receiving structures.

21. A load pad for a load-bearing animal as described in claim 20, wherein said material includes a polyester mesh with PVC coating.

22. A load pad for a load-bearing animal as described in claim 21, wherein said mesh is adjacent the load-bearing animal when the receiving structures are positioned on the load-bearing animal.

23. A load pad for a load-bearing animal as described in claim 21, wherein said mesh is adjacent the load when the receiving structures are positioned on the load-bearing animal.

24. A load pad for a load-bearing animal as described in claim 21, wherein said mesh is adjacent both the load and the load-bearing animal when the receiving structures are positioned on the load-bearing animal.

25. A load pad for a load-bearing animal as described in claim 13, further comprising a strap member for connecting said receiving structures underneath a load-bearing animal and holding the load pad in position on the load-bearing animal.

26. A load pad for a load-bearing animal as described in claim 25, wherein a breathable material including a polyester mesh with PVC coating is located between the strap and the load-bearing animal with mesh adjacent the load-bearing animal when the strap is used to hold the load pad in position on a load-bearing animal.

27. A load pad for a load-bearing animal as described in claim 13, further comprising connection points for a strap member for connecting said receiving structures underneath a load-bearing animal and holding the load pad in position on the load-bearing animal.

28. A load pad for a load-bearing animal as described in claim 13, wherein said inflatable members can be removed from said receiving structures.

29. A load pad for a load-bearing animal as described in claim 13, wherein neither the receiving structures nor the top connection substantially contact a supraspinous ligament of the load-bearing animal.

30. A load pad for a load-bearing animal as described in claim 13, wherein an open gullet channel is maintained proximate a supraspinous ligament of the load-bearing animal.

31. A load pad for a load-bearing animal as described in claim 13, wherein neither the receiving structures nor the top connection contact the load-bearing animal's withers.

32. A load pad for a load-bearing animal, as described in claim 13, further comprising a connector adapted to bridge a load-bearing animal's withers.

33. A load pad for a load-bearing animal, as described in claim 13, further comprising a connector adapted to bridge a load-bearing animal's withers, which connector is adapted to serve as a hand-hold.

34. A load pad for a load-bearing animal, comprising:

a left pad adapted for placement adjacent the left side of a load-bearing animal, said pad having a lower surface adapted for placement adjacent said animal and an upper surface opposite therefrom, with portions of at least one of said upper and lower surfaces being covered by a non-slip breathable material, which material includes a polyester mesh with PVC coating, which mesh is oriented outwardly from the pad;

a right pad adapted for placement adjacent the right side of a load-bearing animal, said pad having a lower surface adapted for placement adjacent said animal and an upper surface opposite therefrom, with portions of at least one of said upper and lower surfaces being covered by a non-slip breathable material, which material includes a polyester mesh with PVC coating, which mesh is oriented outwardly from the pad; and a top connection adapted for linking said pads across an upper portion of the load-bearing animal such that said pads hang over said upper portion adjacent the right and left sides of the load-bearing animal.

35. A load pad for a load-bearing animal as described in claim 34, wherein said pads are formed from resilient breathable moisture wicking materials.

36. A load pad for a load-bearing animal as described in claim 34, wherein said mesh is adjacent the load-bearing animal when the pads are positioned on the load-bearing animal.

37. A load pad for a load-bearing animal as described in claim 34, wherein said mesh is adjacent the load when the pads are positioned on the load-bearing animal.

38. A load pad for a load-bearing animal as described in claim 34, further comprising a strap member for connecting said pads underneath a load-bearing animal and holding the load pad in position on the load-bearing animal.

39. A load pad for a load-bearing animal as described in claim 38, wherein a breathable material including a polyester mesh with PVC coating is placed between the strap and the load-bearing animal with mesh adjacent the load-bearing animal when the strap is used to hold the load pad in position on a load-bearing animal.

40. A load pad for a load-bearing animal as described in claim 34, further comprising connection points for a strap member for connecting said receiving structures underneath a load-bearing animal and holding the load pad in position on the load-bearing animal.

41. A load pad for a load-bearing animal as described in claim 34, further comprising two inflatable members adapted for placement within the pads on opposite upper sides of the load-bearing animal between the load-bearing animal and portions of a load resting on the animal's sides, the inflatable members being shaped to conform to and pad the portions of the load resting on the upper sides of the load-bearing animal, the inflatable members also having foam cores with a cell structure that absorbs atmospheric air, which foam cores are wholly surrounded by and bonded to thin skins which form fluid tight envelopes around said foam cores, which thin skins have openings for transmitting air between the foam cores and the atmosphere, which transmission of air is controlled by valves in said openings.

42. A load pad for a load-bearing animal as described in claim 41, wherein said valves are proportionate valves adjustable to different pressure settings, which different pressure settings allow air to escape from the valves until setting pressures are reached.

43. A load pad for a load-bearing animal as described in claim 41, wherein said inflatable members can be removed from said pads.

44. A load pad for a load-bearing animal as described in claim 34, wherein neither the pads nor the top connection substantially contact a supraspinous ligament of the load-bearing animal.

45. A load pad for a load-bearing animal as described in claim 34, wherein an open gullet channel is maintained proximate a supraspinous ligament of the load-bearing animal.

46. A load pad for a load-bearing animal as described in claim 34, wherein neither said pads nor the top connection contacts the load-bearing animal's withers.

47. A load pad for a load-bearing animal, as described in claim 34, further comprising a connector adapted to bridge a load-bearing animal's withers.

48. A load pad for a load-bearing animal, as described in claim 34, further comprising a connector adapted to bridge a load-bearing animal's withers, which connector is adapted to serve as a hand-hold.

49. A valve for use with an inflatable member, comprising a proportionate valve, which proportionate valve is adjustable to different pressure settings corresponding to different weight load settings for weight loads to be placed on the inflatable member, which different weight load settings allow air to escape from the proportionate valve until weight load setting pressures are reached, and which different weight load settings inhibit air from escaping from the inflatable member in direct proportion to weight loads placed on the inflatable member.

50. A valve as described in claim 49, wherein said proportionate valve uses a spring member to hold the valve closed and the tension of said spring is adjustable to different pressure settings such that said spring will hold the valve closed only if the pressure exerted by a gas on the valve is not greater than the setting pressure.

51. A valve as described in claim 50, wherein the tension of said spring is adjusted and the pressure set by turning a rotating member.

52. A valve as described in claim 51, wherein said rotating member has a marker that can be moved to correspond to different pressure setting indicators by turning the rotating member.

53. A valve as described in claim 51, wherein said rotating member has snap members that snap into indents when the rotating member is turned.

54. A seat pad, comprising:

at least one inflatable member having a foam core with a cell structure that absorbs atmospheric air, which foam core is wholly surrounded by and bonded to a thin skin which forms a fluid tight envelope around said foam core, which thin skin has an opening for transmitting air between the foam core and the atmosphere, which transmission of air is controlled by a valve in said opening; and fasteners for affixing said at least one inflatable member to a seat.

55. A seat pad as described in claim 54, further comprising non-slip breathable material placed outwardly of said at least one inflatable member proximate at least one of an upper surface and lower surface of said inflatable member.

56. A seat pad as described in claim 55, wherein said non-slip breathable material includes a polyester mesh with PVC coating, which mesh is oriented outwardly from the at least one inflatable member.

57. A seat pad as described in claim 54, wherein said valve is a proportionate valve adjustable to different pressure settings, which different pressure settings allow air to escape from the valve until setting pressures are reached.

58. A seat pad, comprising:

at least one pad formed from resilient material with a non-slip breathable material placed outwardly of said resilient material proximate at least one of an upper surface and a lower surface of said resilient material, which non-slip breathable material includes a polyester mesh with PVC coating, which mesh is oriented outwardly from the resilient material;

fasteners for affixing said at least one pad to a seat; and at least one inflatable member has a foam core with a cell structure that absorbs atmospheric air, which foam core is wholly surrounded by and bonded to a thin skin which forms a fluid tight envelope around said foam core, which thin skin has an opening for transmitting air between the foam core and the atmosphere, which transmission of air is controlled by a valve in said opening.

59. A seat pad as described in claim 58, wherein said valve is a proportionate valve adjustable to different pressure settings, which different pressure settings allow air to escape from the valve until setting pressures are reached.

* * * * *